US009484012B2

(12) United States Patent
Morita

(10) Patent No.: US 9,484,012 B2
(45) Date of Patent: Nov. 1, 2016

(54) SPEECH SYNTHESIS DICTIONARY GENERATION APPARATUS, SPEECH SYNTHESIS DICTIONARY GENERATION METHOD AND COMPUTER PROGRAM PRODUCT

(71) Applicant: KABUSHIKI KAISHA TOSHIBA, Minato-ku, Tokyo (JP)

(72) Inventor: Masahiro Morita, Kanagawa (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 0 days.

(21) Appl. No.: 14/606,089

(22) Filed: Jan. 27, 2015

(65) Prior Publication Data

US 2015/0228271 A1 Aug. 13, 2015

(30) Foreign Application Priority Data

Feb. 10, 2014 (JP) ..... 2014-023617

(51) Int. Cl.
*G10L 13/00* (2006.01)
*G10L 13/033* (2013.01)

(52) U.S. Cl.
CPC ..... *G10L 13/033* (2013.01)

(58) Field of Classification Search
USPC ..... 704/257–275
See application file for complete search history.

(56) References Cited

U.S. PATENT DOCUMENTS 6,343,270 B1 * 1/2002 Bahl ..... G10L 13/08 704/235
6,711,542 B2 * 3/2004 Theimer ..... G06F 17/2715 704/2
7,082,392 B1 * 7/2006 Butler ..... 704/233
7,225,125 B2 * 5/2007 Bennett ..... G06F 17/3043 704/233
7,412,387 B2 * 8/2008 Faisman ..... G10L 15/22 704/257
7,472,061 B1 12/2008 Alewine et al.
7,496,511 B2 * 2/2009 Vora ..... G06F 9/4448 704/246
7,957,969 B2 6/2011 Alewine et al.
8,275,621 B2 9/2012 Alewine et al.
2013/0080155 A1 3/2013 Tachibana et al.

FOREIGN PATENT DOCUMENTS

JP 11-249695 9/1999
JP 2001-282096 10/2001
JP 2002-244689 8/2002
JP 2013-072903 4/2013

* cited by examiner

*Primary Examiner* — Jesse Pullias
(74) *Attorney, Agent, or Firm* — Amin, Turocy & Watson LLP

(57) ABSTRACT

According to an embodiment, a speech synthesis dictionary generation apparatus includes an analyzer, a speaker adapter, a level designation unit, and a determination unit. The analyzer analyzes speech data and generates a speech database containing characteristics of utterance by an object speaker. The speaker adapter generates the model of the object speaker by speaker adaptation of converting a base model to be closer to characteristics of the object speaker based on the database. The level designation unit accepts designation of a target speaker level representing a speaker's utterance skill and/or a speaker's native level in a language of the speech synthesis dictionary. The determination determines a parameter related to fidelity of reproduction of speaker properties in the speaker adaptation, in accordance with a relationship between the target speaker level and a speaker level of the object speaker.

11 Claims, 10 Drawing Sheets

WHEN SPEAKER HAS RELATIVELY HIGH OBJECT SPEAKER LEVEL

WHEN SPEAKER HAS LOW OBJECT SPEAKER LEVEL

SPEECH SYNTHESIS DICTIONARY GENERATION APPARATUS, SPEECH SYNTHESIS DICTIONARY GENERATION METHOD AND COMPUTER PROGRAM PRODUCT

CROSS-REFERENCE TO RELATED APPLICATION

This application is based upon and claims the benefit of priority from Japanese Patent Application No. 2014-023617, filed on Feb. 10, 2014; the entire contents of which are incorporated herein by reference.

FIELD

Embodiments described herein relate generally to a speech synthesis dictionary generation apparatus, a speech synthesis dictionary generation method and a computer program product.

BACKGROUND

In speech synthesis, there is an increasing need that not only a voice is selected from a small amount of candidates previously prepared for reading, but also a speech synthesis dictionary of voices of specific speakers such as well-recognized persons and familiar persons is newly generated for reading a variety of text contents. In order to satisfy such a need, a technique has been proposed in which a speech synthesis dictionary is automatically generated from speech data of an object speaker who is an object of dictionary generation. Also, as a technique of generating a speech synthesis dictionary from a small amount of speech data of an object speaker, there is a speaker adaptation technique in which a previously prepared model representing the average characteristics of a plurality of speakers is converted so as to become closer to the characteristics of an object speaker thereby to generate a model of the object speaker.

A main object of conventional techniques of automatically generating a speech synthesis dictionary is to resemble a voice and a speaking manner of an object speaker as much as possible. However, an object speaker who becomes an object of dictionary generation includes not only a professional narrator and a voice actor but also a general speaker who has never received voice training. For this reason, when the utterance skill of an object speaker is low, the low skill comes to be faithfully reproduced, resulting in a speech synthesis dictionary that is hard to use in some applications.

In addition, there is also a need for generation of a speech synthesis dictionary not only in a native language of an object speaker but also in a foreign language with a voice of an object speaker. To satisfy this need, if a speech of an object speaker reading a foreign language can be recorded, a speech synthesis dictionary of the language can be generated from this recorded speech. However, when a speech synthesis dictionary is generated from a recorded speech including incorrect phonation as phonation of the language or including unnatural phonation with an accent, the characteristics of the phonation are reflected on the speech synthesis dictionary. Accordingly, when native speakers listen to the speech synthesized with the speech synthesis dictionary, they cannot understand it.

DETAILED DESCRIPTION

According to an embodiment, a speech synthesis dictionary generation apparatus is for generating a speech synthesis dictionary containing a model of an object speaker based on speech data of the object speaker. The apparatus includes a speech analyzer, a speaker adapter, a target speaker level designation unit, and a determination unit. The speech analyzer is configured to analyze the speech data and generate a speech database containing data representing characteristics of utterance by the object speaker. The speaker adapter is configured to generate the model of the object speaker by performing speaker adaptation of converting a predetermined base model to be closer to characteristics of the object speaker based on the speech database. The target speaker level designation unit is configured to accept designation of a target speaker level that is a speaker level to be targeted. The speaker level represents at least one of a speaker's utterance skill and a speaker's native level in a language of the speech synthesis dictionary. The determination unit is configured to determine a value of a parameter related to fidelity of reproduction of speaker properties in the speaker adaptation, in accordance with a relationship between the designated target speaker level and an object speaker level that is the speaker level of the object speaker. The determination unit is configured to determine the value of the parameter so that the fidelity is lower when the designated target speaker level is higher than the object speaker level, compared to when the designated target speaker level is not higher than the object speaker level. The speaker adapter is configured to perform the speaker adaptation in accordance with the value of a parameter determined by the determination unit.

First Embodiment

Figure 1:
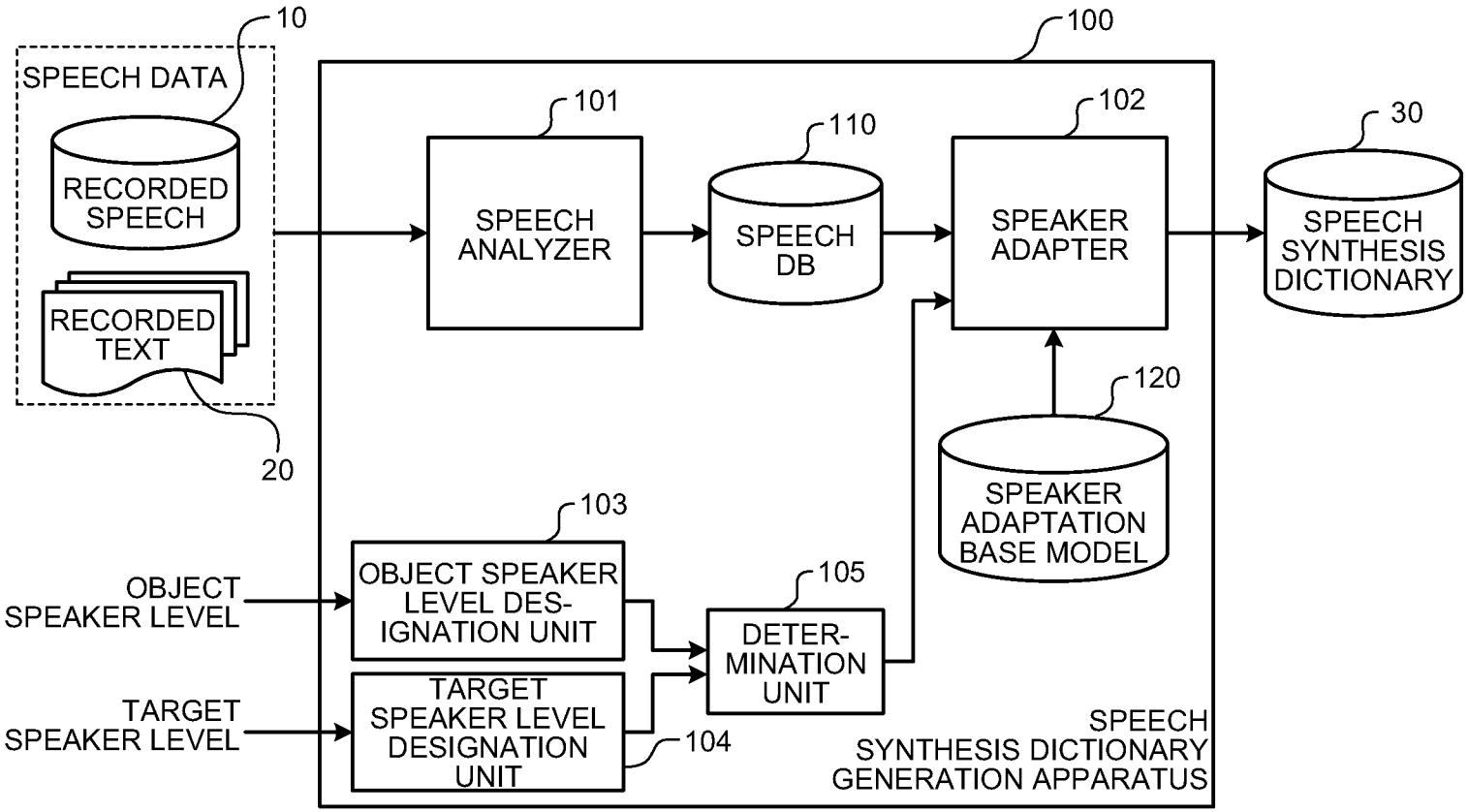
FIG. 1 is a block diagram illustrating a configuration example of a speech synthesis dictionary generation apparatus according to a first embodiment.

FIG. 1 is a block diagram illustrating a configuration example of a speech synthesis dictionary generation apparatus 100 according to the present embodiment. As illustrated in FIG. 1, the speech synthesis dictionary generation apparatus 100 according to the present embodiment includes a speech analyzer 101, a speaker adapter 102, an object speaker level designation unit 103, a target speaker level designation unit 104, and a determination unit 105. In response to input of a recorded speech 10 of an optional object speaker who is an object of dictionary generation, and a text 20 (hereinafter, referred to as a "recorded text") corresponding to read contents of the recorded speech 10, the speech synthesis dictionary generation apparatus 100 generates a speech synthesis dictionary 30 containing a model of the object speaker obtained by modeling the voice quality and the speaking manner of the object speaker.

In the above-described configuration, while the object speaker level designation unit 103, the target speaker level designation unit 104 and the determination unit 105 are constituents unique to the present embodiment, the constituents other than these are a configuration common among the speech synthesis dictionary generation apparatuses using a speaker adaptation technique.

Figure 2:
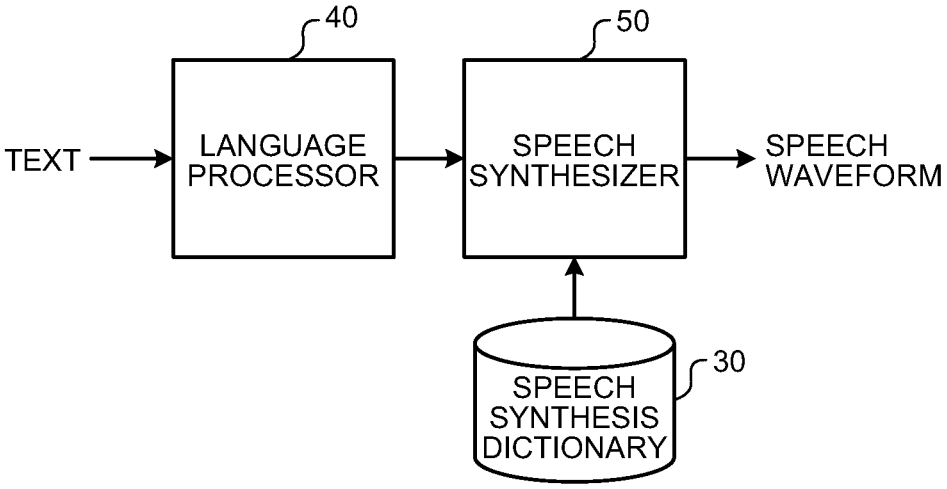
FIG. 2 is a block diagram illustrating a schematic configuration of a speech synthesis apparatus.

The speech synthesis dictionary 30 generated by the speech synthesis dictionary generation apparatus 100 according to the present embodiment is data necessary in a speech synthesis apparatus, and contains an acoustic model obtained by modeling a voice quality, a prosodic model obtained by modeling prosody such as intonation and rhythm, and other various information necessary for speech synthesis. A speech synthesis apparatus is usually constituted by, as illustrated in FIG. 2, a language processor 40 and a speech synthesizer 50, and generates, in response to input of a text, a speech waveform corresponding to the text. The language processor 40 analyzes the input text to acquire a pronunciation and an accent (stress) position of each word, positions of pauses, and other various linguistic information such as word boundary and part-of-speech, and delivers the acquired information to the speech synthesizer 50. Based on the delivered information, the speech synthesizer 50 generates a prosodic pattern such as intonation and rhythm using the prosodic model contained in the speech synthesis dictionary 30, and further generates a speech waveform using the acoustic model contained in the speech synthesis dictionary 30.

In a case of a method based on an HMM (Hidden Markov Model) as disclosed in JP-A 2002-244689 (KOKAI), a prosodic model and an acoustic model contained in the speech synthesis dictionary 30 are obtained by modeling a correspondence relation between the phonological and linguistic information acquired by linguistically analyzing a text and the parameter sequence of prosody, sound and the like. Specifically, the synthesis dictionary includes decision trees with which probability distributions of each parameter of each state are clustered in phonological and linguistic environments, and the probability distributions of each parameter assigned to respective leaf nodes of the decision tree. Examples of the prosodic parameter include a pitch parameter representing the intonation of the speech, and phonetic durations representing the lengths of respective phonetic states of the speech. Examples of the acoustic parameter include a spectrum parameter representing the characteristics of a vocal tract and an aperiodic index representing aperiodic degrees of a sound source signal. The state indicates an internal state when a time change of each parameter is modeled by an HMM. Usually, each phoneme section is modeled by an HMM having three to five states among which transition is accomplished from left to right without reversion, and therefore contains three to five states. Accordingly, for example, a decision tree for the first state of a pitch parameter, where probability distributions of pitch values in a head section within a phoneme section are clustered in phonological and linguistic environments, is traced based on phonological and linguistic information regarding an object phoneme section, so that a probability distribution of a pitch parameter in a head section within the phoneme can be acquired. A normal distribution is often used for a probability distribution of a parameter. In such a case, the probability distribution is expressed by an mean vector representing the center of a distribution, and a covariance matrix representing the spread of a distribution.

The speech synthesizer 50 selects a probability distribution for each state of each parameter using the above-described decision tree, generates a parameter sequence having a highest probability based on these probability distributions, and generates a speech waveform based on these parameter sequences. In a method based on a common HMM, a sound source waveform is generated based on a pitch parameter and an aperiodic index generated, and a vocal tract filter in which filter characteristics change over time in accordance with a generated spectrum parameter is convolved with the generated sound source waveform, thereby to generate a speech waveform.

The speech analyzer 101 analyzes the recorded speech 10 and the recorded text 20 input in the speech synthesis dictionary generation apparatus 100 to generate a speech database (hereinafter, referred to as a speech DB) 110. The speech DB 110 contains various acoustic and prosodic data required in speaker adaptation, that is, data representing the characteristics of utterance by an object speaker. Specifically, the speech DB 110 contains a time sequence (for example, for each frame) of each parameter, such as of a spectrum parameter representing the characteristics of a spectrum envelope, an aperiodic index representing the ratio of the aperiodic component in each frequency band, and a pitch parameter representing the fundamental frequency (F0); a series of phonetic labels, and time information (such as the start time and the end time of each phoneme) and linguistic information (the accent (stress) position, the orthography, a part-of-speech, connection strengths with previous and next words, of the word containing the phoneme) regarding each label; information on the position and length of each pause; and the like. The speech DB 110 contains at least a part of the above-described information, but may contain information other than the information described herein. Also, while a mel-frequency cepstrum (mel-cepstrum) and a mel-frequency line spectral pairs (mel-LSP) are generally used as a spectrum parameter in many cases, any parameter may be used as long as the parameter represents the characteristics of a spectrum envelope.

In the speech analyzer 101, in order to generate the above-described information contained in the speech DB 110, processes such as phoneme labeling, fundamental frequency extraction, spectrum envelope extraction, aperiodic index extraction and linguistic information extraction are automatically performed. There are known methods for each of these processes. Any thereof may be used, or another new method may be used. For example, a method using an HMM is generally used for phoneme labeling. For fundamental frequency extraction, there are many methods including a method using autocorrelation of a speech waveform, a method using cepstrum, and a method using a harmonic structure of a spectrum. For spectrum envelope extraction, there are many methods including a method using pitch synchronous analysis, a method using cepstrum, and a method called STRAIGHT. For aperiodic index extraction, there are a method using autocorrelation in a speech waveform for each frequency band, a method of dividing a speech waveform into the periodic component and the aperiodic component by a method called a PSHF to calculate a power ratio for each frequency band, and the like. For linguistic information extraction, the information on accent (stress) position, part-of-speech, connection strength between words, etc., is acquired based on the results obtained by performing language processing such as morphological analysis.

The speech DB 110 generated by the speech analyzer 101 is used, together with a speaker adaptation base model 120, for generating a model of an object speaker in the speaker adapter 102.

The speaker adaptation base model 120 is, similarly to the model contained in the speech synthesis dictionary 30, obtained by modeling a correspondence relation between the phonological and linguistic information acquired by linguistically analyzing a text, and the parameter sequence of a spectrum parameter, a pitch parameter, an aperiodic index and the like. Usually, a model that is obtained by training a model representing the average characteristics of speakers from a large volume of speech data of the plurality of persons and that covers an extensive phonological and linguistic environment is used as the speaker adaptation base model 120. For example, in a case of a system based on an HMM as disclosed in JP-A 2002-244689 (KOKAI), the speaker adaptation base model 120 includes decision trees with which probability distributions of each parameter are clustered in phonological and linguistic environments, and the probability distributions of each parameter assigned to respective leaf nodes of the decision trees.

Examples of the training method of the speaker adaptation base model 120 include a method of training an "speaker-independent model" using a common model training system in the HMM speech synthesis, from speech data of a plurality of speakers, as disclosed in JP-A 2002-244689 (KOKAI); and a method of training while normalizing the variation in characteristics among speakers using a method called Speaker Adaptive Training (SAT) as disclosed in J. Yamagishi and T. Kobayashi, "Average-Voice-Based Speech Synthesis Using HSMM-Based Speaker Adaptation and Adaptive Training", IEICE Trans. Information and Systems, Vol. No. 2, pp. 533-543 (2007-2).

In the present embodiment, the speaker adaptation base model 120 is, in principle, trained from speech data of a plurality of speakers who are natives of the language and has high phonation skills.

The speaker adapter 102 performs speaker adaptation using the speech DB 110 to convert the speaker adaptation base model 120 so as to be closer to the characteristics of an object speaker (a speaker of the recorded speech 10), to generate a model having a voice quality and a speaking manner closer to those of the object speaker. Here, a method such as maximum likelihood linear regression (MLLR), constrained maximum likelihood linear regression (cMLLR) and structural maximum a posteriori linear regression (SMAPLR) is used to optimize the probability distribution possessed by the speaker adaptation base model 120 in accordance with the parameters in the speech DB 110, so that the speaker adaptation base model 120 comes to have characteristics closer to those of the object speaker. For example, in a case of a method using maximum likelihood linear regression, an average vector $\mu_i$ in the probability distribution of a parameter assigned to leaf node i in a decision tree is converted according to Equation (1) below. Here, A and W are matrices; b and $\xi_i$ are vectors; $\xi_i=[1, \mu_i^T]^T$ (T is transposition); and W=[bA]. W is called a regression matrix.

$$\bar{\mu}=A\mu_i+b=W\xi_i \quad (1)$$

In the conversion according to Equation (1), the conversion is performed after optimizing regression matrix W such that the likelihood of a converted probability distribution with respect to the parameter for a model of an object speaker becomes highest. Although the covariance matrix may be converted in addition to the average vector of a probability distribution, a detailed description thereof will be omitted herein.

In such conversion by the maximum likelihood linear regression, all of the probability distributions for the leaf nodes in a decision tree may be converted with one common regression matrix. However, in this case, since the difference in speaker properties generally varies depending on phonological aspects and the like, the conversion comes to be extraordinarily coarse. This sometimes inhibits the speaker properties of an object speaker from being sufficiently reproduced, and furthermore, causes the phonological properties to deteriorate. On the other hand, when speech data of an object speaker exist in a large amount, the speaker adaptation can be performed in an extraordinarily precise manner by preparing a different regression matrix for the probability distribution of each leaf node. However, since the speech data of an object speaker are often in a small amount when speaker adaptation is used, the speech data of the object speaker assigned to each leaf node are extraordinarily few, or do not exist at all in some cases, resulting in the occurrence of many leaf nodes in which the calculation of a regression matrix cannot be performed.

Figure 3:
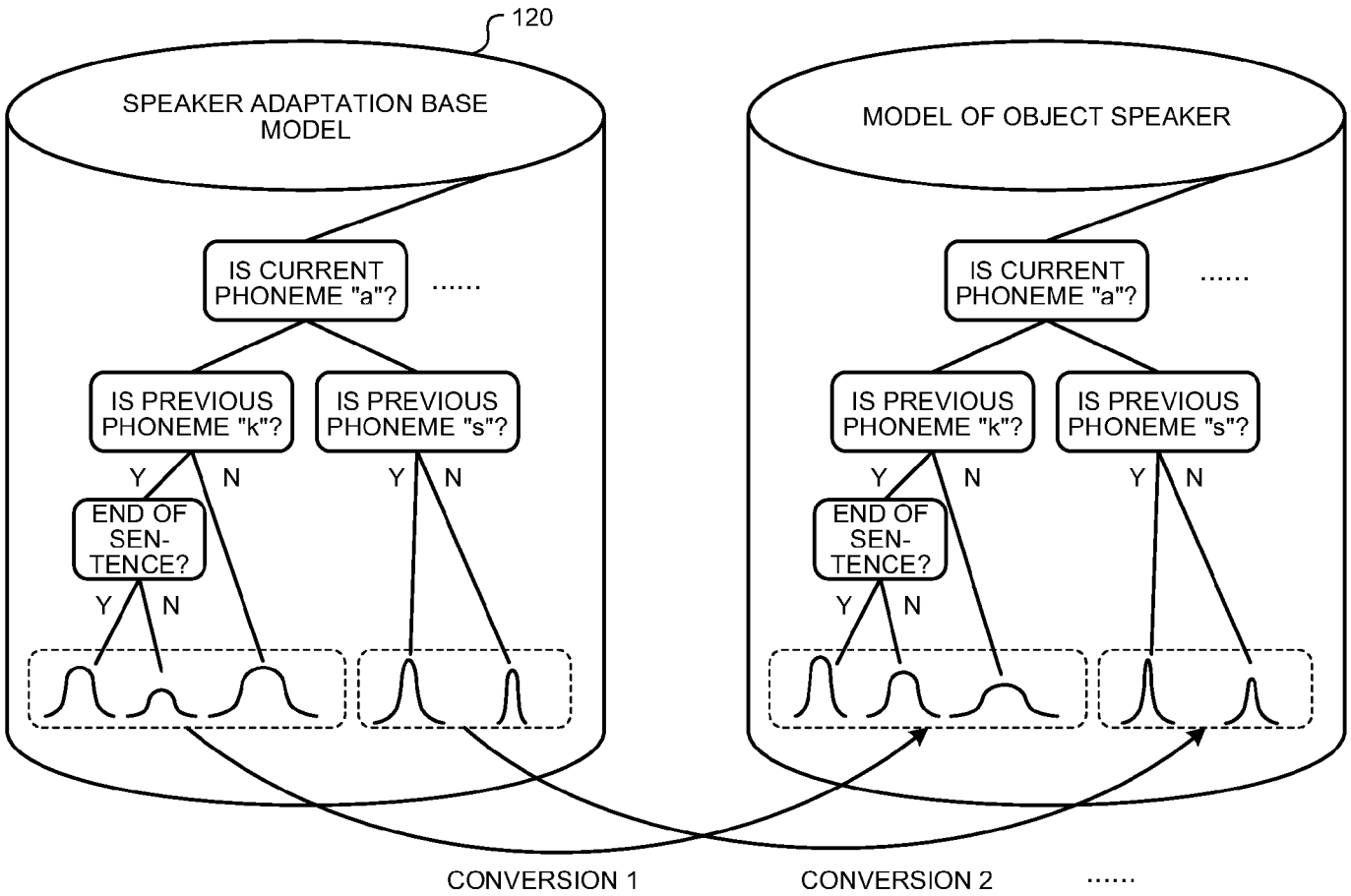
FIG. 3 is a conceptual diagram of piecewise linear regression used in speaker adaptation based on an HMM method.

To address this concern, the probability distributions to be converted are usually clustered into a plurality of regression classes. Then, converted matrices are calculated for each of the regression classes to perform the conversion of probability distributions. Such conversion is called piecewise linear regression. The image thereof is illustrated in FIG. 3. In the clustering into the regression classes, there are usually used a decision tree (usually a binary tree) of the speaker adaptation base model 120 clustered in a phonological and linguistic environment as illustrated in FIG. 3, and a binary tree being a result from clustering probability distributions in all leaf nodes based on the distance between the probability distributions in terms of physical quantities (hereinafter, the decision tree and the binary tree are referred to as regression class trees). In these methods, a minimum threshold is set for a speech data amount of an object speaker in each regression class, thereby to control the granularity of a regression class in accordance with the speech data amount of an object speaker.

Specifically, it is firstly checked which leaf node of a regression class tree each sample of a parameter of an object speaker is assigned to, and the number of samples assigned to each leaf node is calculated. When there is a leaf node in which the number of assigned samples is smaller than a threshold, a parent node thereof is traced back to, and the parent node and the leaf nodes not higher than the parent node are merged. This operation is repeated until the number of samples for each of all leaf nodes exceeds a minimum threshold, and finally obtained leaf nodes become regression classes. As a result, a small speech data amount of an object speaker causes each of the regression classes to be large (that is, causes the number of converted matrices to become small) resulting in adaptation with coarse granularity, while a large speech data amount causes each of the regression classes to be small (that is, causes the number of converted matrices to be large) resulting in adaptation with fine granularity.

In the present embodiment, the speaker adapter 102 calculates, as described above, a conversion matrix for each regression class to perform the conversion of a probability distribution, and has a parameter that allows the granularity of a regression class (that is, the fidelity of reproduction of speaker properties in speaker adaptation) to be externally controlled, such as a minimum threshold for the speech data amount of an object speaker for each regression class. For example, when a minimum threshold is set for the speech data amount of an object speaker for each regression class to control the granularity of a regression class, a fixed value empirically calculated for each type of prosodic and acoustic parameters is usually used, and a relatively small value within a range of a data amount sufficient for the calculation of a conversion matrix is often set. In this case, the characteristics of a voice quality and phonation of an object speaker can be reproduced as faithfully as possible, in accordance with an available speech data amount.

On the other hand, when such a minimum threshold is set to be a higher value, a regression class becomes large, resulting in adaptation with coarse granularity. In this case, there is generated a model in which while the voice quality and the phonation are closer to those of an object speaker as a whole, the characteristics of the speaker adaptation base model 120 are reflected regarding detailed characteristics. That is, raising this minimum threshold enables the fidelity of reproduction of speaker properties in speaker adaptation to be lowered. According to the present embodiment, in the determination unit 105 described later, the value of such a parameter is determined based on the relationship between the speaker level of an object speaker and the speaker level to be targeted (a speaker level expected to a synthesized speech by the speech synthesis dictionary 30), and the determined value is input to the speaker adapter 102.

It is noted that a term "speaker level" used in the present embodiment indicates at least one of a speaker's utterance skill and a speaker's native level in a language in the speech synthesis dictionary 30 to be generated. The speaker level of an object speaker is called an "object speaker level", and the speaker level to be targeted is called a "target speaker level". The speaker's utterance skill is a value or a category representing the accuracy of pronunciations and accents and the fluency of phonation by a speaker. For example, a speaker having extraordinarily poor phonation is represented by a value of 10, and a professional announcer capable of uttering in an accurate and fluent manner is represented by a value of 100. The native level of a speaker is a value or a category representing whether or not an object language is a mother language of the speaker, and when not a mother language, what degree of a phonation skill the speaker has for the object language. For example, 100 is for the case of a mother language, and 0 is for the case of a language which has never been even learned. The speaker level may be one or both of the phonation skill and the native level, depending on applications. Also, the speaker level may be an index combining the phonation skill and the native level.

The object speaker level designation unit 103 accepts designation of an object speaker level, and delivers the designated object speaker level to the determination unit 105. For example, when a user such as an object speaker him/herself performs an operation of designating an object speaker level using a certain user interface, the object speaker level designation unit 103 accepts the designation of an object speaker level through the operation by the user, and delivers the designated object speaker level to the determination unit 105. It is noted that when the object speaker level can be assumed with, for example, the application of the speech synthesis dictionary 30 to be generated, a fixed assumed value may be previously set as an object speaker level. In this case, the speech synthesis dictionary generation apparatus 100 includes a storage unit that stores a previously set object speaker level in place of the object speaker level designation unit 103.

The target speaker level designation unit 104 accepts designation of a target speaker level, and delivers the designated target speaker level to the determination unit 105. For example, when a user such as an object speaker him/herself performs an operation of designating a target speaker level using a certain user interface, the target speaker level designation unit 104 accepts the designation of a target speaker level through the operation by the user, and delivers the designated target speaker level to the determination unit 105. For example, when the utterance skill and the native level of an object speaker are low, it is sometimes desirable that the voice resemble an object speaker his/herself and that the phonation be more professional or native than the object speaker his/herself. In such a case, a user may only designate a rather higher target speaker level.

The determination unit 105 determines a value of a parameter related to the fidelity of reproduction of speaker properties in speaker adaptation by the speaker adapter 102 described above, in accordance with the relationship between the target speaker level delivered from the target speaker level designation unit 104 and the object speaker level delivered from the object speaker level designation unit 103.

Figure 4:
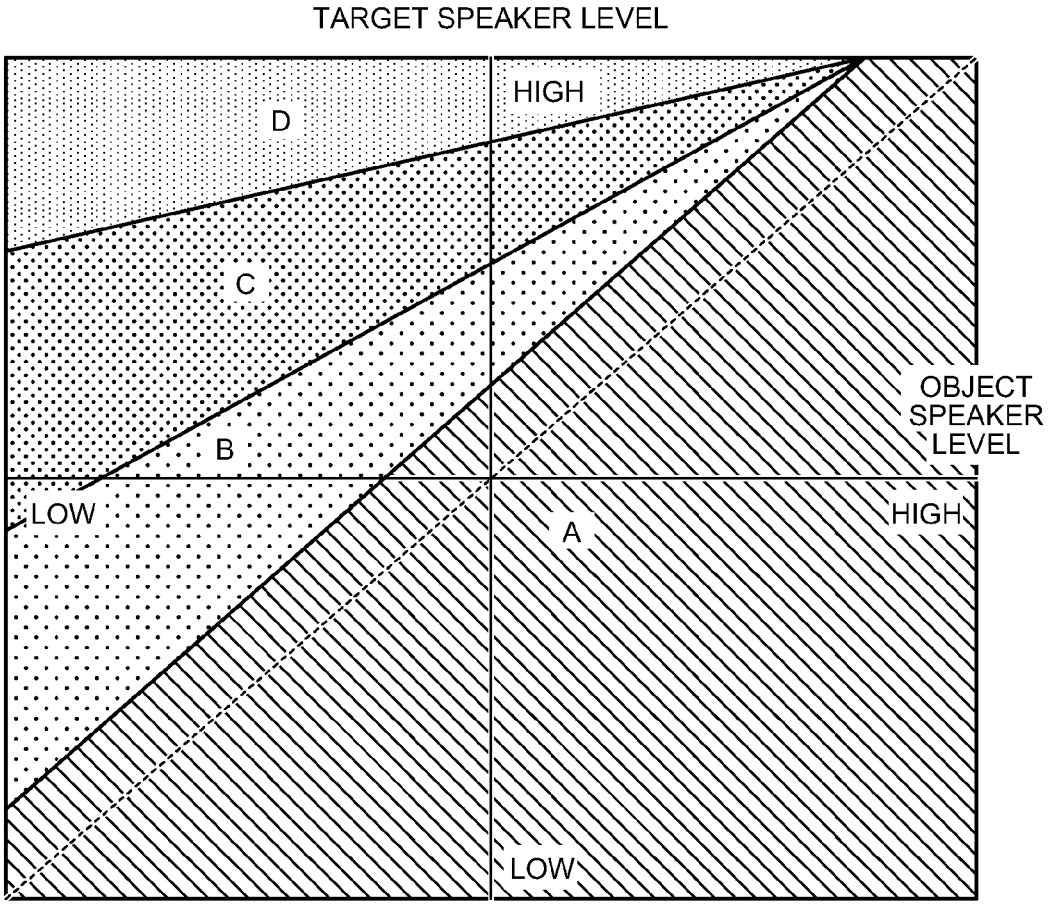
FIG. 4 is a diagram illustrating an example of a parameter determination method by a determination unit.

An example of the method in which the determination unit 105 determines the value of a parameter is illustrated in FIG. 4. FIG. 4 indicates a two-dimensional plane that classifies the relationship between the target speaker level and the object speaker level, in which the horizontal axis corresponds to the size of an object speaker level, and the vertical axis corresponds to the size of a target speaker level. The oblique broken line in the diagram indicates a position where the target speaker level and the object speaker level are equal. The determination unit 105 judges, for example, which of regions A to D in FIG. 4 the relationship between the target speaker level delivered from the target speaker level designation unit 104 and the object speaker level delivered from the object speaker level designation unit 103 falls in. When the relationship between the target speaker level and the object speaker level falls in the region A, the determination unit 105 determines the value of a parameter related to the fidelity of reproduction of speaker properties as being a default value previously determined as a value causing the fidelity of reproduction of speaker properties to become maximum. The region A is a region which the relationship falls in when the target speaker level is not higher than the object speaker level, or when the target speaker level is higher than the object speaker level while the difference therebetween is smaller than a prescribed value. The region A contains a case where the target speaker level is higher than the object speaker level while the difference therebetween is smaller than a prescribed value, because a region in which the value of a parameter is set to be a default value can have a margin in consideration of the uncertainty of a speaker level. However, such a margin is not necessarily needed, and the region A may be only a region which the relationship falls in when the target speaker level is not higher than the object speaker level (a region in the lower right to the oblique broken line in the diagram).

Also, when the relationship between the target speaker level and the object speaker level falls in the region B, the determination unit 105 determines the value of a parameter related to the fidelity of reproduction of speaker properties to be a value causing the fidelity of reproduction of speaker properties to become lower than a default value. Also, when the relationship between the target speaker level and the object speaker level falls in the region C, the determination unit 105 determines the value of a parameter related to the fidelity of reproduction of speaker properties to be a value causing the fidelity of reproduction of speaker properties to become further lower than the case where the relationship between the target speaker level and the object speaker level falls in the region B. Also, when the relationship between the target speaker level and the object speaker level falls in the region D, the determination unit 105 determines the value of a parameter related to the fidelity of reproduction of speaker properties to be a value causing the fidelity of reproduction of speaker properties to become further lower than the case where the relationship between the target speaker level and the object speaker level falls in the region C.

As described above, the determination unit 105 determines the value of a parameter related to the fidelity of reproduction of speaker properties to be a value causing the fidelity of reproduction of speaker properties to become lower than a default value when the target speaker level is higher than the object speaker level, and determines the value of a parameter so that the fidelity of reproduction of speaker properties decreases as the difference therebetween becomes larger. At this time, the changing degree of a parameter may differ between a parameter used for the generation of an acoustic model and a parameter used for the generation of a prosodic model, among the models of an object speaker generated by speaker adaptation.

Since speaker properties of many speakers are more significantly indicated in voice qualities than in prosody, the voice qualities need to be faithfully reproduced. However, regarding the prosody, it is enough to adapt just an average level to the speaker in many cases, thereby enabling the speaker properties to be reproduced to some extent. Also, for many speakers, while it is relatively easy to pronounce an utterance in such a manner that each syllable in the utterance can be correctly caught, it is difficult, unless properly trained, to read in such a manner that prosody such as accents, intonation and rhythm sounds natural and can be easily caught, like a professional narrator. This also applies to a case of reading foreign languages. For example, when a Japanese speaker who has never learned Chinese reads Chinese, each syllable can be correctly pronounced to some extent when reading Chinese Pinyin or Japanese kana converted from the Chinese Pinyin. However, it is almost impossible to read Chinese in correct tone (the four tones in a case of standard Chinese). To address this concern, the changing degree of a parameter used for the generation of a prosodic model from its default value may be adjusted so as to be higher than the changing degree of a parameter used for the generation of an acoustic model from its default value, when determining the value of a parameter related to the fidelity of reproduction of speaker properties so that the fidelity of reproduction of speaker properties is lower than the default value. Accordingly, it becomes possible to easily generate the speech synthesis dictionary 30 balancing between the reproduction of speaker properties and the height of an utterance skill.

For example, in a case where the above-described minimum threshold for the speech data amount of an object speaker for each regression class is used as a parameter related to the fidelity of reproduction of speaker properties, when the relationship between the target speaker level and the object speaker level falls in the region B of FIG. 4, the value of a parameter used for the generation of an acoustic model is set to be 10 times a default value, and the value of a parameter used for the generation of a prosodic model is set to be 10 times a default value. Also, when the relationship between the target speaker level and the object speaker level falls in the region C of FIG. 4, the value of a parameter used for the generation of an acoustic model is set to be 30 times a default value, and the value of a parameter used for the generation of a prosodic model is set to be 100 times a default value. Also, a method is conceivable in which when the relationship between the target speaker level and the object speaker level falls in the region D of FIG. 4, the value of a parameter used for the generation of an acoustic model is set to be 100 times a default value, and the value of a parameter used for the generation of a prosodic model is set to be 1000 times a default value.

As described above, in the speech synthesis dictionary generation apparatus 100 according to the present embodiment, the designation of a target speaker level higher than an object speaker level causes the fidelity of reproduction of speaker properties in speaker adaptation to automatically decrease, thereby to generate the speech synthesis dictionary 30 in which while the voice quality and the phonation are closer to those of a speaker as a whole, the detailed characteristics are the characteristics of the speaker adaptation base model 120, that is, the characteristics being high in an utterance skill and a native level in the language. In this manner, according to the speech synthesis dictionary generation apparatus 100 of the present embodiment, there can be generated the speech synthesis dictionary 30 allowing the similarity of speaker properties to be adjusted in accordance with the utterance skill and the native level to be targeted. Accordingly, even when the utterance skill of an object speaker is low, speech synthesis with a high utterance skill can be achieved. Also, even when the native level of an object speaker is low, speech synthesis with phonation closer to a native can be achieved.

Second Embodiment

In the first embodiment, an object speaker level is designated by an object speaker him/herself such as a user, or is a fixed assumed value that is previously set. However, it is extraordinarily difficult to designate and set an appropriate object speaker level suited for an actual utterance skill and a native level in the recorded speech 10. To address this concern, in the present embodiment, an object speaker level is estimated based on an analysis result of speech data of an object speaker by the speech analyzer 101, to determine a value of a parameter related to the fidelity of reproduction of speaker properties in accordance with the relationship between the designated target speaker level and the estimated object speaker level.

Figure 5:
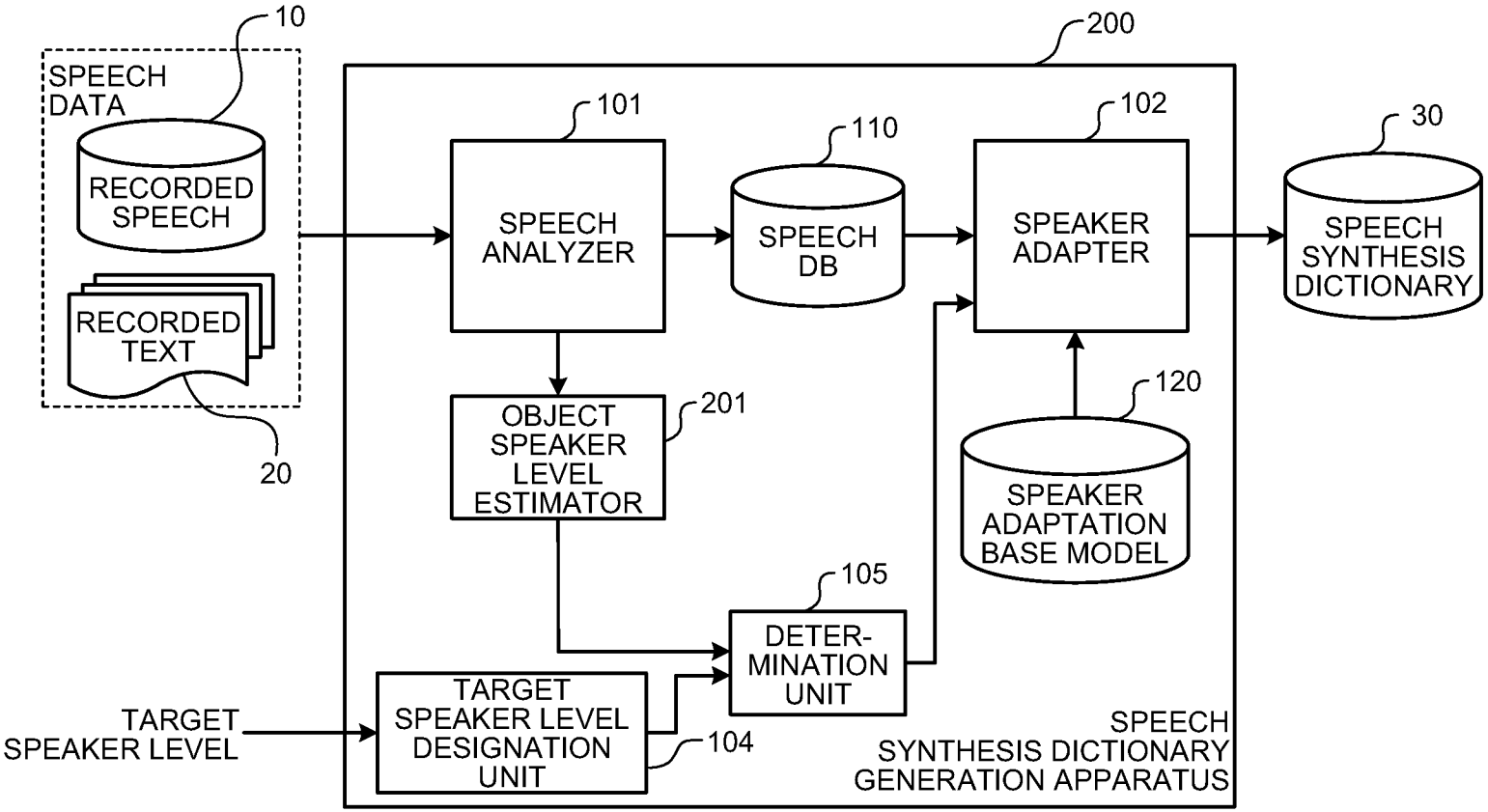
FIG. 5 is a block diagram illustrating a configuration example of a speech synthesis dictionary generation apparatus according to a second embodiment.

FIG. 5 is a block diagram illustrating a configuration example of a speech synthesis dictionary generation apparatus 200 according to the present embodiment. As illustrated in FIG. 5, the speech synthesis dictionary generation apparatus 200 according to the present embodiment includes an object speaker level estimator 201 in place of the object speaker level designation unit 103 illustrated in FIG. 1. Since the configuration other than this is similar to that in the first embodiment, the redundant description will be omitted by assigning the same reference numerals in the diagram with respect to the constituents common to those in the first embodiment.

The object speaker level estimator 201 judges an utterance skill and a native level of an object speaker, based on the result of phoneme labeling and the extracted information such as a pitch and a pause in the speech analyzer 101. For example, since an object speaker having a low utterance skill tends to have a higher incidence of a pause than a fluent speaker, the utterance skill of the object speaker can be judged using this information. Also, there have been various techniques for automatically judging the utterance skill of a speaker from a recorded speech for the purpose of, for example, language learning. An example thereof is disclosed in JP-A 2006-201491 (KOKAI).

In the technique disclosed in JP-A 2006-201491 (KOKAI), the evaluation value related to the pronunciation level of a speaker is calculated from the probability value obtained as a result of performing alignment of the speech of a speaker using an HMM model as teacher data. Any of these existing techniques may be used.

As above, according to the speech synthesis dictionary generation apparatus 200 of the present embodiment, an object speaker level suited to an actual speaker level in the recorded speech 10 is automatically judged. Accordingly, there can be generated the speech synthesis dictionary 30 in which a designated target speaker level is appropriately reflected.

Third Embodiment

The target speaker level designated by a user not only influences the utterance level and the native level of the speech synthesis dictionary 30 (a model of an object speaker) to be generated, but also practically comes to adjust a trade-off with the similarity of an object speaker. That is, when a target speaker level is set higher than the utterance level and the native level of an object speaker, the similarity of speaker properties of the object speaker comes to be sacrificed to some extent. However, in the first and second embodiments, a user only designates a target speaker level. Accordingly, a user can hardly image what speech synthesis dictionary 30 is finally generated. Also, while a range in which such a trade-off can be practically adjusted comes to be limited to a degree by the utterance level and the native level of the recorded speech 10, a user still needs to set a target speaker level without previously knowing this.

To address this concern, in the present embodiment, the relationship between the target speaker level to be designated and the similarity of speaker properties assumed in the speech synthesis dictionary 30 (a model of an object speaker) to be generated as a result of the designation, and the range in which a target speaker level can be designated are presented to a user through, for example, display by a GUI, in accordance with the input recorded speech 10. Thus, a user can image what speech synthesis dictionary 30 is to be generated in response to how a target speaker level is designated.

Figure 6:
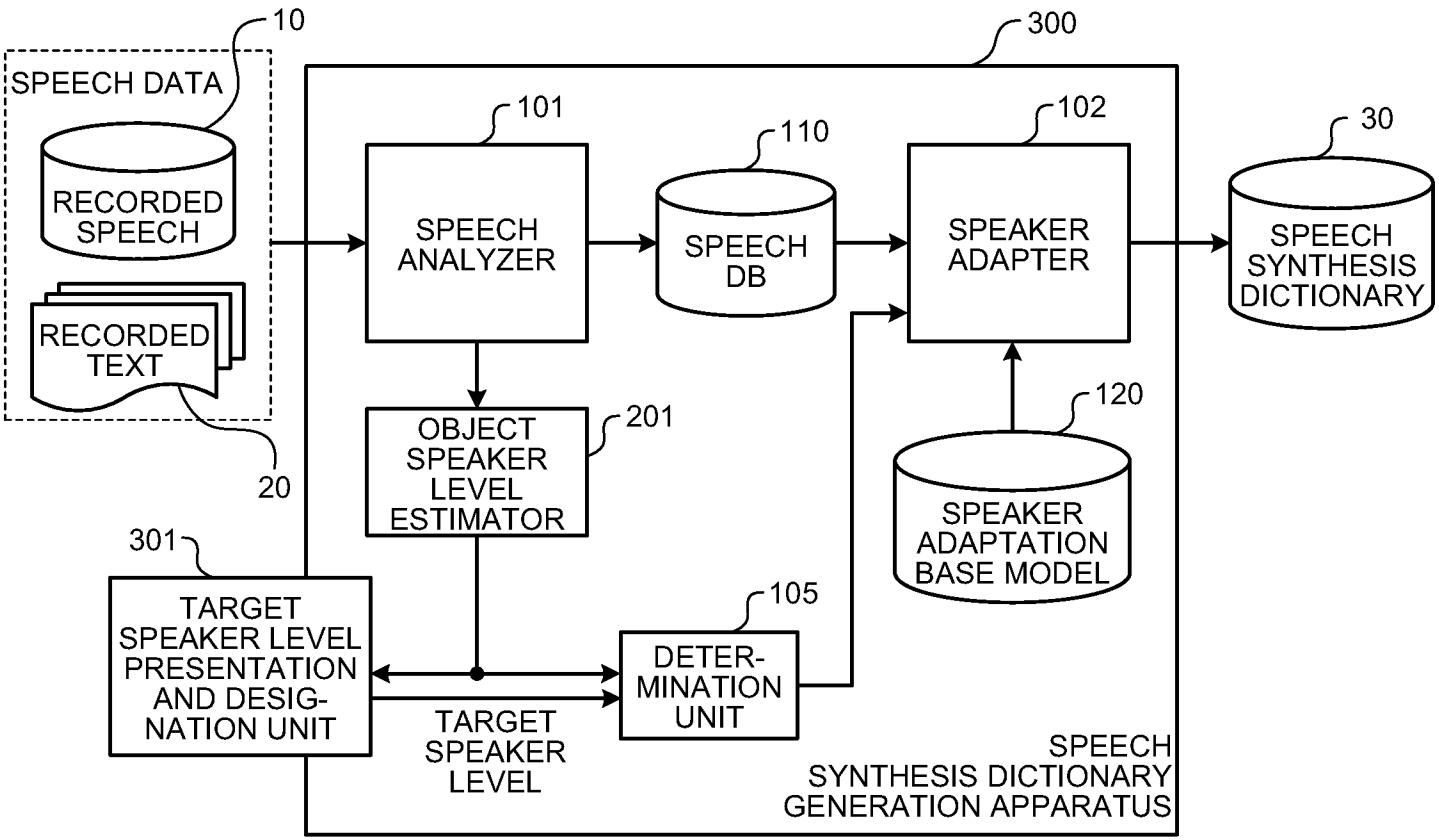
FIG. 6 is a block diagram illustrating a configuration example of a speech synthesis dictionary generation apparatus according to a third embodiment.

FIG. 6 is a block diagram illustrating a configuration example of a speech synthesis dictionary generation apparatus 300 according to the present embodiment. As illustrated in FIG. 6, the speech synthesis dictionary generation apparatus 300 according to the present embodiment includes a target speaker level presentation and designation unit 301 in place of the target speaker level designation unit 104 illustrated in FIG. 5. Since the configuration other than this is similar to those in the first and second embodiments, the redundant description will be omitted by assigning the same reference numerals in the diagram with respect to the constituents common to those in the first and second embodiments.

In the speech synthesis dictionary generation apparatus 300 according to the present embodiment, in response to input of the recorded speech 10, an object speaker level is estimated in the object speaker level estimator 201, and this estimated object speaker level is delivered to the target speaker level presentation and designation unit 301.

The target speaker level presentation and designation unit 301 calculates the relationship among the range in which a target speaker level can be designated, the target speaker level within this range, and the similarity of speaker properties assumed in the speech synthesis dictionary 30, based on the object speaker level estimated by the object speaker level estimator 201. Then, the target speaker level presentation and designation unit 301 displays the calculated relationship on, for example, a GUI, while accepting a user's operation of designating a target speaker level using the GUI.

Figure 7A:
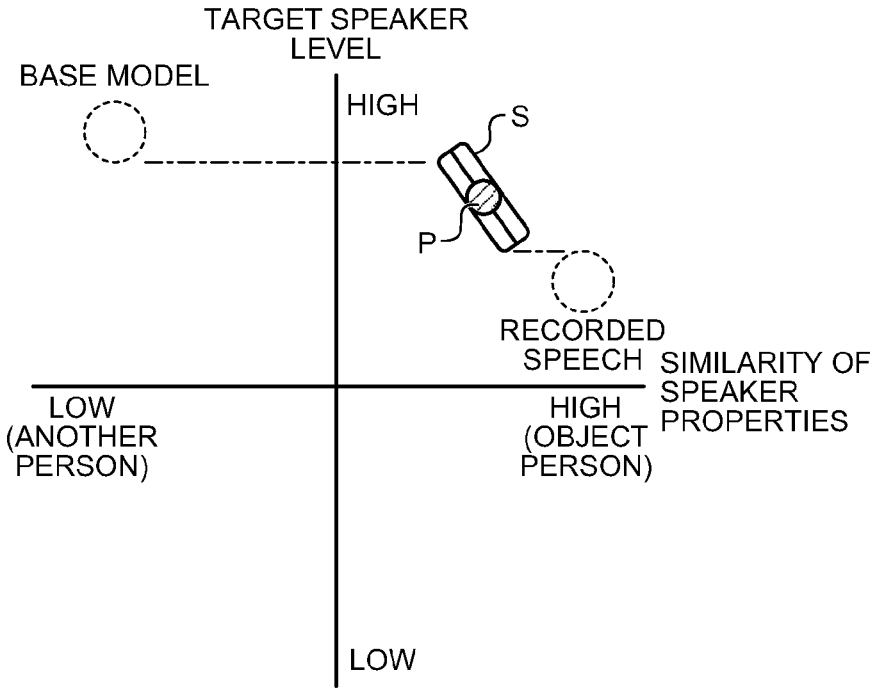
FIGS. 7A and 7B are diagrams each illustrating a display example of a GUI for specifying a target speaker level.
Figure 7B:
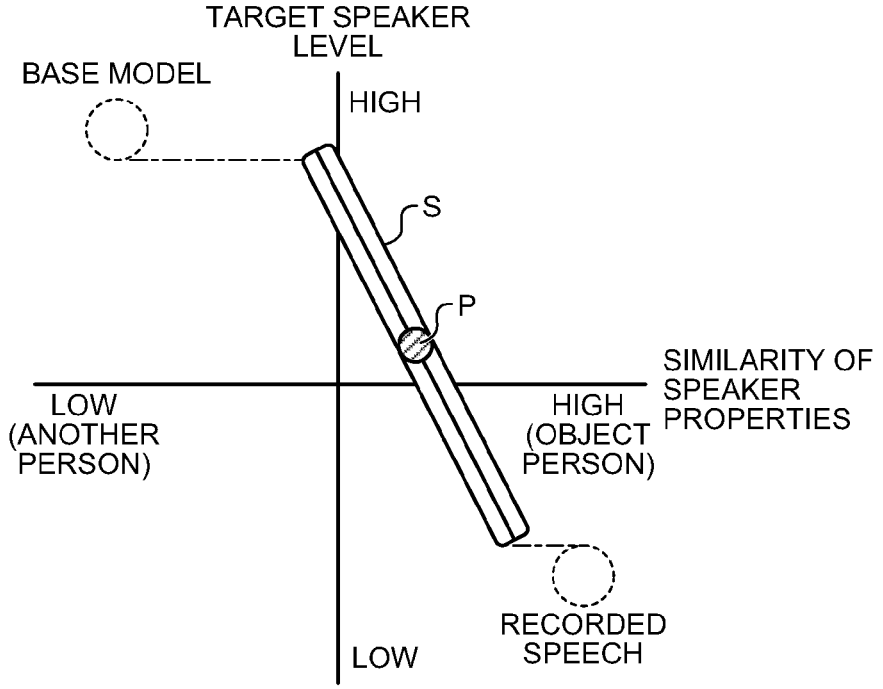

Display examples by this GUI are illustrated in FIGS. 7A and 7B. FIG. 7A is a display example of a GUI when an object speaker level is estimated as being relatively high, and FIG. 7B is a display example of a GUI when an object speaker level is estimated as being low. A slider S indicating the range in which a target speaker level can be designated is disposed in each of these GUIs. A user moves a pointer p within the slider S to designate a target speaker level. The slider S is obliquely displayed on the GUI, and the position of the pointer p within the slider S indicates the relationship between the designated target speaker level and the similarity of speaker properties assumed in the speech synthesis dictionary 30 (a model of an object speaker) to be generated. It is noted that the dashed circles in the diagram indicate the speaker level and the similarity of speaker properties for each of when the speaker adaptation base model 120 is used as it is and when the recorded speech 10 is faithfully reproduced. The circle for the speaker adaptation base model 120 is located in the upper left in the diagram, because while the speaker level is high, the voice and the speaking manner are of a totally different person. On the other hand, the circle for the recorded speech 10 is located in the right end in the diagram because of an object speaker him/herself, and the vertical position changes in accordance with the height of an object speaker level. The slider S extends between the two dashed circles, and means that while the setting of faithfully reproducing an object speaker causes both the speaker level and the similarity of speaker properties to become closer to the recorded speech 10, a highly set target speaker level results in speaker adaptation with coarse granularity causing the similarity of speaker properties to be sacrificed to some extent. As illustrated in FIGS. 7A and 7B, when the difference in a speaker level between the speaker adaptation base model 120 and the recorded speech 10 is larger, the range in which the target speaker level can be set becomes wider.

The target speaker level designated by a user through the GUI illustrated as an example in FIGS. 7A and 7B is delivered to the determination unit 105. In the determination unit 105, the value of a parameter related to the fidelity of a speaker in speaker adaptation is determined, based on the relationship with the object speaker level delivered from the object speaker level estimator 201. In the speaker adapter 102, speaker adaptation is performed in accordance with the determined value of a parameter, thereby enabling the generation of the speech synthesis dictionary 30 having the speaker level and the similarity of speaker properties intended by a user.

Fourth Embodiment

In the first to third embodiments, an example of using a general speaker adaptation system in an HMM speech synthesis has been described. However, a speech synthesis system different from that in the first to third embodiments may be used as long as the speech synthesis system has a parameter related to the fidelity of reproduction of speaker properties.

One of the different speaker adaptation systems is a speaker adaptation system using a model trained by a cluster adaptive training (CAT), as in K. Yanagisawa, J. Latorre, V. Wan, M. Gales and S. King, "Noise Robustness in HMM-TTS Speaker Adaptation" Proc. of 8th ISCA Speech Synthesis Workshop, pp. 119-124, 2013-9. In the present embodiment, this speaker adaptation system using a model trained by a cluster adaptive training is used.

Figure 8:
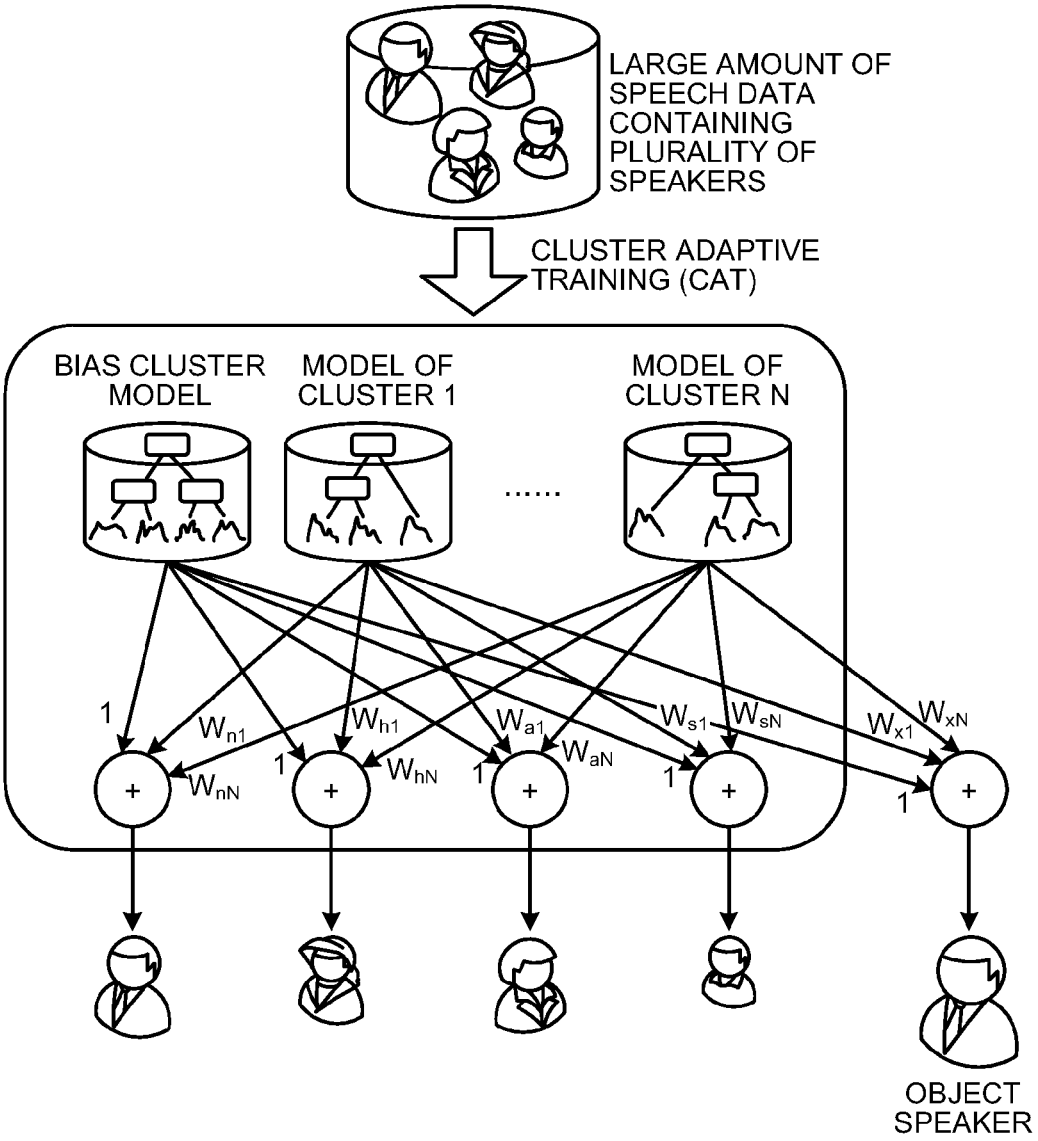
FIG. 8 is a conceptual diagram of speaker adaptation using a model trained in a cluster adaptive training.

In a cluster adaptive training, a model is represented by a weighted sum of a plurality of clusters. During training of a model, a model and a weight of each cluster are simultaneously optimized according to data. In the modeling of a plurality of speakers for speaker adaptation used in the present embodiment, as illustrated, in FIG. 8, the decision tree obtained by modeling each cluster and the weight of a cluster are simultaneously optimized, from a large amount of speech data containing a plurality of speakers. The weight of a model obtained as described above is set to the value optimized for each speaker used for training, thereby enabling the characteristics of each speaker to be reproduced. Hereinafter, a model obtained as described above is called a CAT model.

In practice, the CAT model is trained for each parameter type such as a spectrum parameter and a pitch parameter, in a similar manner to the decision tree described in the first embodiment. The decision tree of each cluster is obtained by clustering each parameter in a phonological and linguistic environment. A probability distribution (an average vector and a covariance matrix) of an object parameter is allocated to a leaf node of a cluster called a bias cluster in which the weight is always set to be 1. To each of the leaf nodes of other clusters, an average vector to be added with a weight to the average vector of the probability distribution from the bias cluster is allocated.

In the present embodiment, the CAT model trained by a cluster adaptive training as described above is used as the speaker adaptation base model 120. In the speaker adaptation of this case, a weight can be optimized according to the speech data of an object speaker, thereby to obtain a model having a voice quality and a speaking manner close to the object speaker. However, this CAT model can usually represent only the characteristics within a space that can be expressed by a linear sum of the characteristics of the speakers used for training. Accordingly, for example, when the speakers used for training are mostly professional narrators, the voice quality and the speaking manner of a general person may not be satisfactorily reproduced. To address this concern, in the present embodiment, a CAT model is trained from a plurality of speakers having various speaker levels and containing the characteristics of various voice qualities and speaking manners.

In this case, when the weight vector optimized for the speech data of an object speaker is $W_{opt}$, the speech synthesized by this weight vector $W_{opt}$ is closer to that of the object speaker, but the speaker level also comes to be a reproduction of the level of an object speaker. On the other hand, when the weight vector closest to $W_{opt}$ is selected as $W_{s(near)}$ from the weight vectors optimized for the speakers having a high speaker level among the speakers used for training of a CAT model, a speech synthesized by this weight vector $W_{s(near)}$ is relatively close to that of an object speaker and has a high speaker level. It is noted that while $W_{s(near)}$ is one closest to $W_{opt}$ herein, $W_{s(near)}$ is not necessarily selected based on the distance of a weight vector, and may be selected based on other information such as gender and characteristics of a speaker.

In the present embodiment, furthermore, a weight vector $W_{target}$ that interpolates $W_{opt}$ and $W_{s(near)}$ is newly defined as Equation (2) below, and $W_{target}$ is assumed to be a weight vector (a target weight vector) as a result of speaker adaptation.

$$w_{target}=r\cdot w_{opt}+(1-r)\cdot W_{s(near)}\ (0\leq r\leq 1) \tag{2}$$

Figure 9:
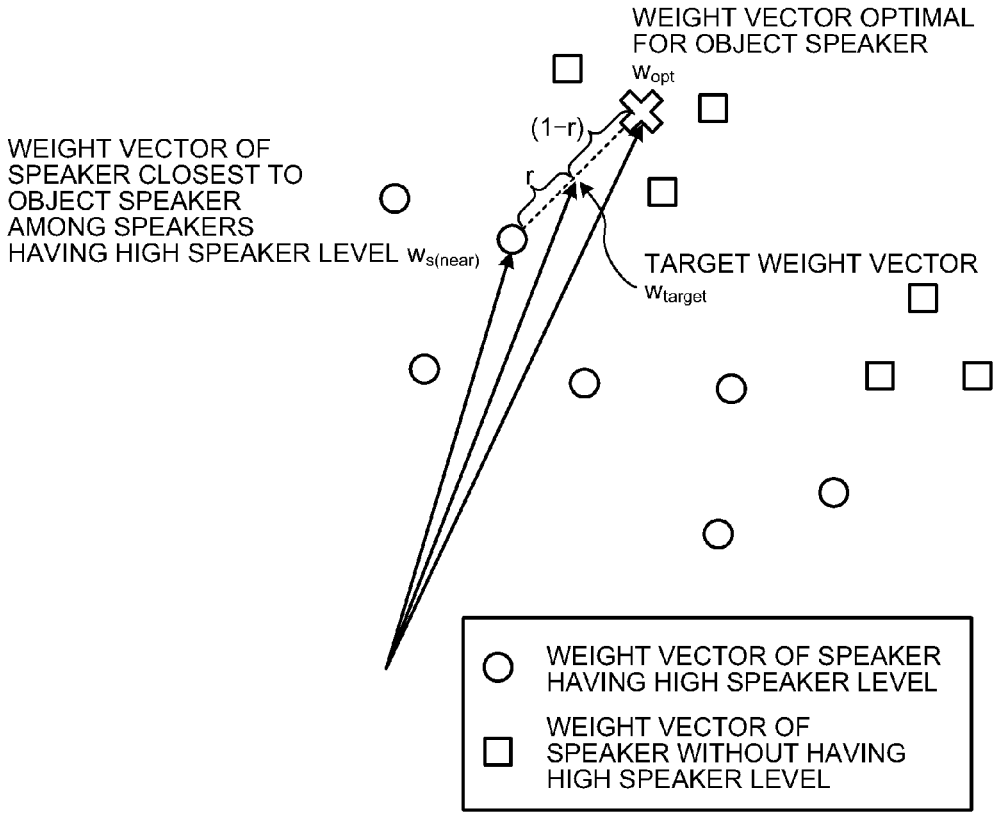
FIG. 9 is a conceptual diagram illustrating a relationship between an interpolation ratio r and a target weight vector in Equation (2)

FIG. 9 is a conceptual diagram illustrating the relationship between r as an interpolation ratio in Equation (2) and a target weight vector $W_{target}$ defined by r. In this case, for example, an interpolation ratio r of 1 allows for the setting in which an object speaker is most faithfully reproduced, and an interpolation ratio r of 0 allows for the setting having a highest speaker level. In brief, this interpolation ratio r can be used as a parameter representing the fidelity of speaker reproducibility. In the present embodiment, in the determination unit 105, the value of this interpolation ratio r is determined based on the relationship between the target speaker level and the object speaker level. Thus, in a similar manner to the first to third embodiments, there can be generated the speech synthesis dictionary 30 allowing the similarity of speaker properties to be adjusted in accordance with the utterance skill and the native level to be targeted. Accordingly, even when the utterance skill of an object speaker is low, speech synthesis with a high utterance skill can be achieved. Also, even when the native level of an object speaker is low, speech synthesis with phonation closer to a native can be achieved.

Fifth Embodiment

In the first to fourth embodiments, an example of generating the speech synthesis dictionary 30 for HMM speech synthesis has been described. However, a system for speech synthesis is not limited to the HMM speech synthesis, and may be a different speech synthesis method such as unit selection-type speech synthesis. An example of the unit selection-type speech synthesis includes a speaker adaptation method as disclosed in JP-A 2007-193139 (KOKAI).

In the speaker adaptation method disclosed in JP-A 2007-193139 (KOKAI), a speech unit of a base speaker is converted in accordance with the characteristics of an object speaker (a target speaker). Specifically, a speech waveform of a speech unit is speech-analyzed to be converted into a spectrum parameter, and this spectrum parameter is converted into the characteristics of an object speaker on a spectrum domain. Thereafter, the converted spectrum parameter is converted back to a speech waveform in a time domain to obtain a speech waveform of an object speaker.

As for a rule of the above conversion, a pair of the speech unit of a base speaker and the speech unit of an object speaker is created using the method of unit selection, and these speech units are speech-analyzed to be converted into a pair of spectrum parameters. Furthermore, the conversion is modeled with regression analysis, vector quantization or mixed Gaussian distribution (GMM) based on the pair of spectrum parameters for generation. That is, similarly to the speaker adaptation by HMM speech synthesis, the conversion is made in a domain of a parameter such as a spectrum. Also, in some conversion systems, a parameter related to the fidelity of reproduction of speaker properties exists.

For example, in the system using vector quantization among the conversion systems listed in JP-A 2007-193139

(KOKAI), a spectrum parameter of a base speaker is clustered into C clusters, to generate a conversion matrix for each cluster by maximum likelihood linear regression or the like. In this case, C that is the number of clusters can be used as a parameter related to the fidelity of reproduction of speaker properties. As C becomes larger, the fidelity becomes higher, and as C becomes smaller, the fidelity becomes lower. Also, in the conversion system using GMM, a rule for the conversion from a base speaker to an object speaker is expressed by C Gaussian distributions. In this case, the mixed number C of Gaussian distributions can be used as a parameter related to the fidelity of reproduction of speaker properties.

In the present embodiment, the number C of clusters in the conversion system using vector quantization, or the mixed number C of Gaussian distributions in the conversion system using GMM, as described above, is used as a parameter related to the fidelity of reproduction of speaker properties. The value of the number C of clusters or the mixed number C of Gaussian distributions is determined in the determination unit 105, based on the relationship between a target speaker level and an object speaker level. Thus, even when speech synthesis is performed by a system other than the HMM speech synthesis system, such as unit selection-type speech synthesis, there can be generated, similarly to the first to fourth embodiments, the speech synthesis dictionary 30 allowing the similarity of speaker properties to be adjusted in accordance with the utterance skill and the native level to be targeted. Accordingly, even when the utterance skill of an object speaker is low, speech synthesis with a high utterance skill can be achieved. Furthermore, even when the native level of an object speaker is low, speech synthesis with phonation closer to a native can be achieved.

Sixth Embodiment

When the native level of a speaker is low, such as when the speech synthesis dictionary 30 in an unfamiliar language is generated, it is predicted that the recording of a speech in the language becomes extraordinarily difficult. For example, in a speech recording tool, it is difficult for a Japanese speaker unfamiliar to Chinese to read a Chinese text displayed as it is. To address this concern, in the present embodiment, recording of speech samples is performed while presenting to an object speaker a phonetic description in a language usually used by the object speaker, which is converted from information on the pronunciation of an utterance. Furthermore, the information presented is switched in accordance with the native level of an object speaker.

Figure 10:
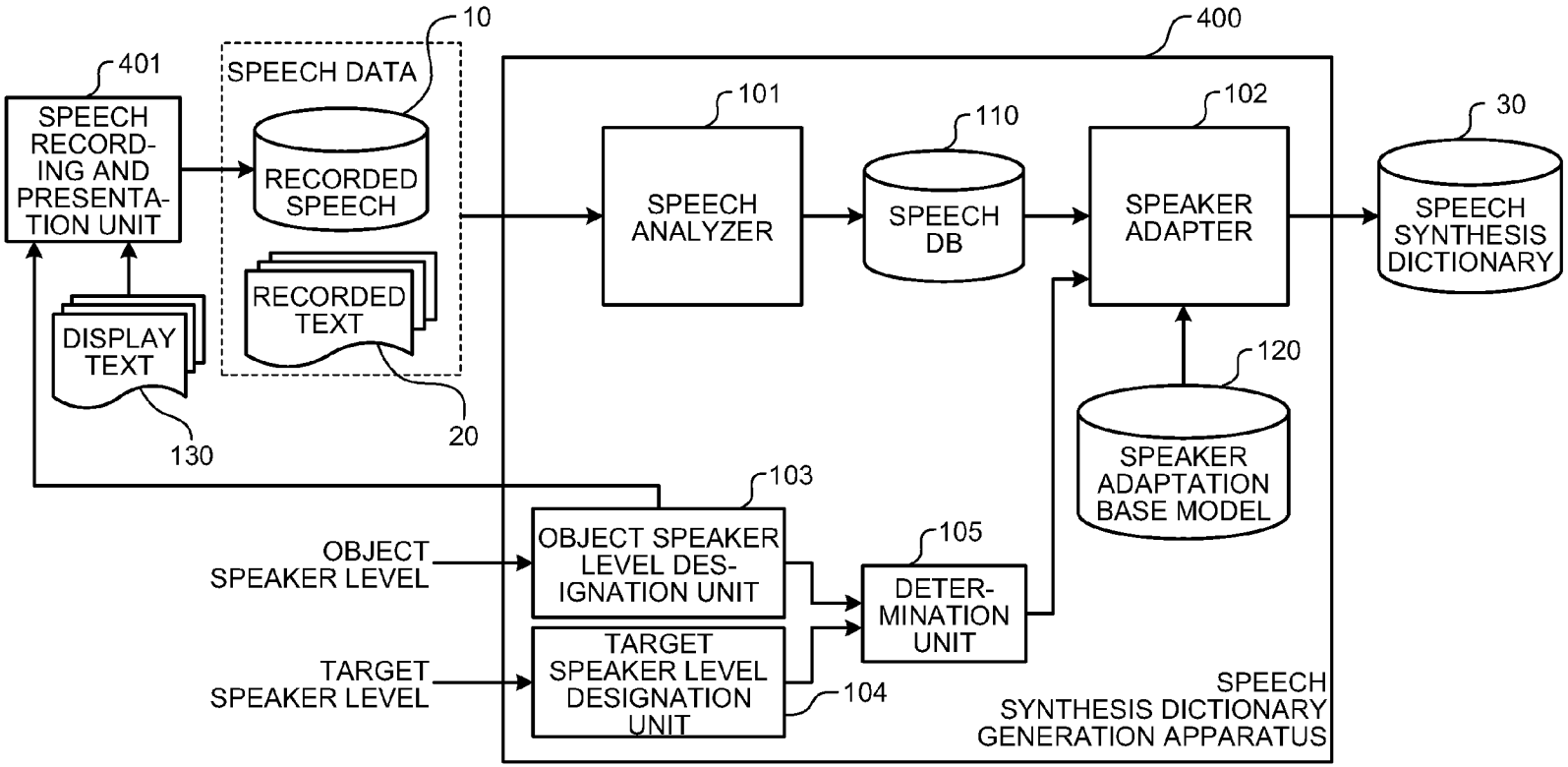
FIG. 10 is a block diagram illustrating a configuration example of a speech synthesis dictionary generation apparatus according to a sixth embodiment.

FIG. 10 is a block diagram illustrating a configuration example of a speech synthesis dictionary generation apparatus 400 according to the present embodiment. As illustrated in FIG. 10, the speech synthesis dictionary generation apparatus 400 according to the present embodiment includes a speech recording and presentation unit 401 in addition to the configuration of the first embodiment illustrated in FIG. 1. Since the configuration other than this is similar to that in the first embodiment, the redundant description will be omitted by assigning the same reference numerals in the diagram with respect to the constituents common to those in the first embodiment.

The speech recording and presentation unit 401 presents to an object speaker a display text 130 including a phonetic description in a language usually used by the object speaker, which is converted from the description of the recorded text 20, when the object speaker reads out the recorded text 20 in a language other than the language usually used by the object speaker. For example, when generating the speech synthesis dictionary 30 in Chinese for the Japanese as an object, the speech recording and presentation unit 401 displays as a text to be read out, for example, the display text 130 including katakana converted from the pronunciation in Chinese, instead of the text in Chinese. This enables even the Japanese to produce a pronunciation close to the Chinese.

At this time, the speech recording and presentation unit 401 switches the display text 130 presented to an object speaker in accordance with the native level of the object speaker. That is, with respect to accents and tone, a speaker who has learned the language can produce phonation with correct accents and tone. However, for a speaker who has never learned the language with an extraordinarily low native level, even when the accent positions and tone types are appropriately displayed, it is extraordinarily difficult to reflect the displayed accent positions and tone types in his/her phonation. For example, it is almost impossible for a Japanese person who has never learned Chinese to correctly produce phonation of the four tones as the tone of Chinese.

To address this concern, the speech recording and presentation unit 401 according to the present embodiment switches whether or not accent positions, tone types and the like are displayed, in accordance with the native level of an object speaker him/herself designated by the object speaker. Specifically, the speech recording and presentation unit 401 receives the native level of an object speaker, of the object speaker level designated by the object speaker, from the object speaker level designation unit 103. Then, when the native level of an object speaker is higher than a predetermined level, the speech recording and presentation unit 401 displays accent positions and tone types in addition to the description of a reading. On the other hand, when the native level of an object speaker is lower than a predetermined level, the speech recording and presentation unit 401 displays the description of a reading, but does not display accent positions and tone types.

When accent positions and tone types are not displayed, while accents and tones may not be expected to be correctly produced in phonation, it is considered that an object speaker concentrates on correctly pronouncing without paying attention to accents and tones so that the pronunciation can be expected to become correct to some extent. Therefore, when the value of a parameter is determined in the determination unit 105, it is desirable that while the parameter used for the generation of an acoustic model is set rather higher, the value of a parameter used for the generation of a prosodic model is set considerably lower. This increases the possibility of generating the speech synthesis dictionary 30 that allows even an object speaker having an extraordinarily low native level to produce correct phonation to some extent while reflecting the characteristics of the speaker.

It is noted that the object speaker level used when the determination unit 105 determines the value of a parameter may be a level designated by an object speaker, that is, an object speaker level containing a native level delivered from the object speaker level designation unit 103 to the speech recording and presentation unit 401, or may be an object speaker level estimated in the separately disposed object speaker level estimator 201 similar to in the second embodiment, that is, an object speaker level estimated using the recorded speech 10 recorded in the speech recording and presentation unit 401. Also, the object speaker level designated by an object speaker and the object speaker level estimated using the recorded speech 10 may both be used to determine the value of a parameter in the determination unit 105.

The coordination between the switching of the display text 130 presented to an object speaker during the recording of a speech, and the method of determining the value of a parameter representing the fidelity of speaker reproduction in speaker adaptation, as in the present embodiment, enables the speech synthesis dictionary 30 having a certain native level to be more appropriately generated using the recorded speech 10 of an object speaker having a low native level.

As described in detail above by referring to concrete examples, according to the speech synthesis dictionary generation apparatuses according to the embodiments, there can be generated a speech synthesis dictionary in which the similarity of speaker properties is adjusted in accordance with the utterance skill and the native level to be targeted.

It is noted that the speech synthesis dictionary generation apparatuses according to the embodiments described above can utilize a hardware configuration in which, for example, an output device (such as a display and a speaker) and an input device (such as a keyboard, a mouse and a touch panel) which become user interface are connected to a general-purpose computer provided with a processor, a main storage device, an auxiliary storage device and the like. In a case of such a configuration, the speech synthesis dictionary generation apparatuses according to the embodiments cause a processor installed in a computer to execute a predetermined program, thereby to achieve functional constituents such as the speech analyzer 101, the speaker adapter 102, the object speaker level designation unit 103, the target speaker level designation unit 104, the determination unit 105, the object speaker level estimator 201, the target speaker level presentation and designation unit 301 and the speech recording and presentation unit 401 described above. Here, the speech synthesis dictionary generation apparatuses may be achieved by previously installing the above-described program in a computer device, or may be achieved by storing the above-described program in a storage medium such as a CD-ROM or distributing the above-described program through a network to appropriately install this program in a computer. Also, the speech synthesis dictionary generation apparatuses may be achieved by executing the above-described program on a server computer and allowing a result thereof to be received by a client computer through a network.

A program to be executed in a computer has a module structure that contains functional constituents constituting the speech synthesis dictionary generation apparatuses according to the embodiments (such as the speech analyzer 101, the speaker adapter 102, the object speaker level designation unit 103, the target speaker level designation unit 104, the determination unit 105, the object speaker level estimator 201, the target speaker level presentation and designation unit 301, and the speech recording and presentation unit 401). As actual hardware, for example, a processor reads a program from the above-described storage medium and executes the read program, so that each of the above-described processing units is loaded on a main storage device, and is generated on the main storage device. It is noted that a portion or all of the above-described processing constituents can also be achieved using dedicated hardware such as an ASIC and an FPGA.

Also, various information to be used in the speech synthesis dictionary generation apparatuses according to the embodiments can be stored by appropriately utilizing a memory and a hard disk built in or externally attached to the above-described computer or a storage medium such as a CD-R, a CD-RW, a DVD-RAM and a DVD-R, which may be provided as a computer program product. For example, the speech DB 110 and the speaker adaptation base model 120 to be used by the speech synthesis dictionary generation apparatuses according to the embodiments can be stored by appropriately utilizing the storage medium.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A speech synthesis dictionary generation apparatus for generating a speech synthesis dictionary containing a model of an object speaker based on speech data of the object speaker, the apparatus comprising processing circuitry coupled to a memory, the processing circuitry being configured to:

analyze the speech data and generate a speech database containing data representing characteristics of utterance by the object speaker;

generate the model of the object speaker by performing speaker adaptation of converting a predetermined base model to be closer to characteristics of the object speaker based on the speech database;

accept designation of a target speaker level that is a speaker level to be targeted, the speaker level representing at least one of a speaker's utterance skill and a speaker's native level in a language of the speech synthesis dictionary; and determine a value of a parameter related to fidelity of reproduction of speaker properties in the speaker adaptation, in accordance with a relationship between the designated target speaker level and an object speaker level that is the speaker level of the object speaker, wherein the determining determines the value of the parameter so that the fidelity is lower when the designated target speaker level is higher than the object speaker level, compared to when the designated target speaker level is not higher than the object speaker level, and the generating of the model of the object speaker performs the speaker adaptation in accordance with the value of the parameter determined at the determining.

2. The apparatus according to claim 1, wherein the processing circuitry is further configured to accept designation of the object speaker level, and the determining determines the value of the parameter depending on a relationship between the designated target speaker level and the designated object speaker level.

3. The apparatus according to claim 1, wherein the processing circuitry is further configured to automatically estimate the object speaker level based on at least a portion of the speech database, and the determining determines the value of the parameter depending on a relationship between the designated target speaker level and the estimated object speaker level.

4. The apparatus according to claim 1, wherein the accepting displays, based on the object speaker level, a relationship between the target speaker level and similarity of speaker properties assumed in the model of the object speaker to be generated, and a range in which the target speaker level is allowed to be designated, and the accepting accepts an operation of designating the target speaker level within the displayed range.

5. The apparatus according to claim 1, wherein the generating of the model of the object speaker uses as the base model an average voice model obtained by modeling a speaker having a high speaker level.

6. The apparatus according to claim 1, wherein the parameter is a parameter that defines the number of conversion matrices used for conversion of the base model in the speaker adaptation such that as the number of conversion matrices is smaller, the fidelity becomes lower.

7. The apparatus according to claim 1, wherein the generating of the model of the object speaker performs the speaker adaptation by using, as the base model, a model represented by a weighted sum of a plurality of clusters, and adjusting the weight vector to the object speaker, the model being trained by cluster adaptive training from data of a plurality of speakers each having a different speaker level, the weight vector being a set of weights of the plurality of clusters, the weight vector is calculated by interpolating an optimal weight vector for the object speaker and an optimal weight vector of one speaker having a high speaker level among the plurality of speakers, and the parameter is an interpolation ratio to calculate the weight vector.

8. The apparatus according to claim 1, wherein the model of the object speaker includes a prosodic model and an acoustic model, the parameter includes a first parameter used in generation of the prosodic model and a second parameter used in generation of the acoustic model, and the determining sets a larger changing degree of the first parameter from its default value causing a higher fidelity, than a changing degree of the second parameter from its default value, when determining the value of the parameter so that the fidelity is lower.

9. The apparatus according to claim 1, wherein the processing circuitry is further configured to record the speech data while presenting to the object speaker at least information on pronunciation of an utterance text for each utterance unit, and the information on the pronunciation is not represented in a phonetic description of the target language, but in a converted phonetic description of a language usually used by the object speaker, and the information does not contain signs related to intonation such as accents and tones at least when a native level of the object speaker is lower than a predetermined level.

10. A speech synthesis dictionary generation method executed in a speech synthesis dictionary generation apparatus for generating a speech synthesis dictionary containing a model of an object speaker based on speech data of the object speaker, the method comprising:

analyzing the speech data to generate a speech database containing data representing characteristics of utterance by the object speaker;

generating the model of the object speaker by performing speaker adaptation of converting a predetermined base model to be closer to characteristics of the object speaker based on the speech database;

accepting designation of a target speaker level that is a speaker level to be targeted, the speaker level representing at least one of a speaker's utterance skill and a speaker's native level in a language of the speech synthesis dictionary; and determining a value of a parameter related to fidelity of reproduction of speaker properties in the speaker adaptation, in accordance with a relationship between the designated target speaker level and an object speaker level that is the speaker level of the object speaker, wherein the determining includes determining the value of the parameter so that the fidelity is lower when the designated target speaker level is higher than the object speaker level, compared to when the designated target speaker level is not higher than the object speaker level, and the generating includes performing the speaker adaptation in accordance with the value of the parameter determined at the determining.

11. A computer program product comprising a non-transitory computer-readable medium containing a program for generating a speech synthesis dictionary containing a model of an object speaker based on speech data of the object speaker, the program causing a computer to execute:

analyzing the speech data to generate a speech database containing data representing characteristics of utterance by the object speaker;

generating the model of the object speaker by performing speaker adaptation of converting a predetermined base model to be closer to characteristics of the object speaker based on the speech database;

accepting designation of a target speaker level that is a speaker level to be targeted, the speaker level representing at least one of a speaker's utterance skill and a speaker's native level in a language of the speech synthesis dictionary; and determining a value of a parameter related to fidelity of reproduction of speaker properties in the speaker adaptation, in accordance with a relationship between the designated target speaker level and an object speaker level that is the speaker level of the object speaker, wherein the determining includes determining the value of the parameter so that the fidelity is lower when the designated target speaker level is higher than the object speaker level, compared to when the designated target speaker level is not higher than the object speaker level, and the generating includes performing the speaker adaptation in accordance with the value of the parameter determined at the determining.

* * * * *